US006214766B1

(12) United States Patent
Kurrle

(10) Patent No.: US 6,214,766 B1
(45) Date of Patent: Apr. 10, 2001

(54) SECURITY FEATURE FOR PAPER PRODUCTS

(75) Inventor: Frederick L. Kurrle, Laurel, MD (US)

(73) Assignee: Westvaco Corporation, Stamford, CT (US)

( * ) Notice: Subject to any disclaimer, the term of this patent is extended or adjusted under 35 U.S.C. 154(b) by 0 days.

(21) Appl. No.: 09/243,546

(22) Filed: Feb. 3, 1999

(51) Int. Cl.[7] ..... B41M 5/00

(52) U.S. Cl. ..... 503/201; 503/206; 503/217; 503/218

(58) Field of Search ..... 503/206, 217, 503/218, 201

(56) References Cited

U.S. PATENT DOCUMENTS

| | | | | |
|---|---|---|---|---|
| 1,938,543 | | 12/1933 | Sanburn | 92/21 |
| 2,208,653 | | 7/1940 | Whitehead | 92/3 |
| 2,379,443 | | 7/1945 | Kantrowitz et al. | 92/21 |
| 3,001,887 | | 9/1961 | Ahlm, Jr. et al. | 117/1 |
| 3,464,841 | | 9/1969 | Skofronick | 117/1 |
| 5,188,871 | | 2/1993 | Collings | 428/29 |
| 5,393,556 | * | 2/1995 | Romano | 427/7 |
| 5,662,735 | * | 9/1997 | Pifferi | 106/31.2 |

* cited by examiner

*Primary Examiner*—Bruce Hess

(57) ABSTRACT

Authenticatable paper and paperboard products are prepared by printing images such as microdots on one or both surfaces of the paper using a starch containing authenticating solution. The images are not detectable by the human eye, but can be revealed with the application of a standard iodine solution.

6 Claims, No Drawings

SECURITY FEATURE FOR PAPER PRODUCTS

BACKGROUND OF INVENTION

The present invention relates generally to a method for producing security paper. More specifically, the present invention relates to a security feature for both paper and paperboard products which involves the printing images, for example, microdots, on one or both surfaces of the paper using a colorless ink containing starch. Since starch is a common ingredient used during the papermaking process at the wet end, size press and in coating colors, it would be unlikely that one would suspect the use of printed microdots of starch as a security feature for paper.

Traditionally, counterfeiting has been associated with the illicit production of currency. Today, however, there is a significant loss to manufacturers of goods by counterfeiting. This type of counterfeiting costs companies millions of dollars of lost revenue. For example, cigarette, pharmaceutical, computer software and related companies have experienced problems with counterfeited products being sold worldwide. Furthermore, these counterfeited products are usually made cheaply thereby causing an unsuspecting consumer to question the manufacturers' quality.

Thus it would be desirable, and in the best interest of a manufacturer to eliminate to the extent possible the sale of counterfeited products from an economic and public perception point of view. One way to accomplish this result is to provide packaging, labels and the like with security features which can be used for packaging the legitimate products of a manufacturer.

Paper manufacturers have several different options at their disposal for producing paper products with security features. These include the use of watermarks, specialized printing, holographic labels, and the use of synthetic or fluorescent fibers or additives in the packaging materials. Thus the paper used for packaging goods which does not include one of these identifying features may be presumed to include counterfeited products.

Watermarks consist of impressing a design into the wet fiber web prior to couching the paper. Since this process is done early in the papermaking process, it arranges some of the fibers within the paper. This arranging of the fibers makes watermarks difficult to duplicate.

Watermarks are used extensively in European and U.S. currencies and security documents. The security of the watermarking process may be enhanced with the controlled deposition of fibers during the paper forming process and the placing of individual, unigue watermarks on each piece of paper.

The use of watermarks is ideally suited to the manufacture of thin paper such as currencies, bank checks, etc., which are substantially translucent. However, the use of watermarks on heavy weight paper or paperboard normally used for packaging is of less utility because of the low transmission of light through such products. A watermark on these thicker papers would not be readily apparent as in thinner, more translucent papers.

Complicated printing techniques have also been used as security methods for currencies. These are typically lifelike portraits and intricate designs. Additionally, specialty inks, blended exclusively for these end uses, have extensive use in the security document sector. These specialty inks include everything from using multiple colors, to the use of high intensity ultraviolet light to create a pattern fluorescing under visible or ultraviolet light. However, the advent of high quality, color photocopiers have made the use of special inks and intricate designs less of a barrier to the counterfeiter.

In response to the increased ingenuity of counterfeiters, microprinting was developed. Microprinting is a technique where messages, etc., are finely printed on a paper substrate. To the naked eye, the printing appears to be a single line, but under magnification, the messages may be revealed. This technique makes duplication of the paper substrate more troublesome because the printing technique is difficult to reproduce. However, a drawback to the microprinting technique is that it is relatively easy to acquire a printing press. Also, one can set up this printing equipment. anywhere and keep it well hidden.

Holographic labels are also used as an anti-counterfeit device. These labels have an image impressed into them which changes appearance dependant on the point of view. A familiar example of these labels is the shiny image on credit cards. While these are effective as an anti-counterfeit device, they are expensive to produce and keep track of.

Placing dyed synthetic fibers into the paper substrate has been practiced for many years as an anti-counterfeit device. A common example is the paper used for U.S. currency which has blue and red synthetic fibers in it. Though effective, it has a significant drawback because it can only be used in specific applications.

Finally, it is also known to use fibers, pigments and the like in the structure of the paper products that can be identified using various techniques. For example, U.S. Pat. No. 1,938,543 teaches that detectable fibers which have been specially treated with a chemically sensitive substance can be incorporated into paper and, upon contacting such paper with an appropriate chemical agent, the detectable fibers change color and become distinguishable. As illustrated in U.S. Pat. No. 2,208,653, security paper can also be made by including fibers of an organic ester of cellulose that have been treated with a tertiary amine. The treated fibers are invisible in the paper and become fluorescent under ultraviolet light. U.S. Pat. No. 2,379,443 discloses security paper made by the addition of a small percentage of cellulosic fibers that have been treated with hydrated ferric chloride which has been hydrolyzed to iron hydroxide. The treated fibers are capable of acquiring a deep blue color upon application to the paper of a potassium ferrocyanide solution, followed by an orthosphosphoric acid solution. In other prior art related to the present invention, U.S. Pat. No. 3,001,887 teaches the use of collodial silica applied to paper in the form of a latent printing thereon. The latent printing is non-hygroscopic, is not identifiable under ultra-violet light, but will manifest itself with the use of an organic chemical developing solution for authentication. Meanwhile, in U.S. Pat. No. 3,464,841, a security paper product is disclosed wherein a security impression consisting of an ultraviolet absorbing organic chemical is printed on the finished surface of the paper. The impression is without visible perception in normal use but is quickly rendered visible for authentication purposes by simply wetting the paper where the impression is made. Finally in U.S. Pat. No. 5,188,871, a security paper is disclosed which includes both starch and an iodate salt. The starch may be of the type conventionally used in papermaking and may be applied as a wet end additive, at the size press, or as a coating. The iodate salt may be added to the paper during its manufacture, or to formed paper by a coating or printing technique. Such paper is authenticated by applying an authentication composition comprising an acidic solution of an iodide salt wherein iodine is generated and a characteristic starch-iodine coloration is produced.

Nevertheless, the prior art security papers generally have not proven entirely satisfactory because, for example, of their complexity of manufacture, or the fact that papers without a security feature often visibly differ from paper that includes a security feature, or the procedure for testing is cumbersome.

It is apparent from the above that there exists a need in the art for a security paper or paperboard that is inexpensive to manufacture, effective in use, and hard to duplicate. Furthermore, the materials used as a security feature should not interfere with the print characteristics of the paper or the coating operations, nor should the security feature be readily discoverable. It is the purpose of this invention to fulfill these and other needs in the art in a manner more apparent to the skilled artisan once given the following disclosure.

SUMMARY OF INVENTION

In accordance with the present invention, paper and paperboard products may be made authenticatable by the application of a printed image containing starch applied to the paper in a printing operation. A potential counterfeiter would have difficulty in detecting the presence of such an authentication feature since substantial quantities of starch are routinely incorporated in the papermaking process at the wet end, in the size press and in coating colors. The application of a standard iodine solution to the surface of the paper printed with such images produces an instantaneous blue/black color. As an alternative to using the preferred microdots of the present invention, print patterns could be adopted for specific customers and modified or changed on a periodic basis for added security.

It is, therefore, an object of the present invention to provide an easily authenticatable paper or paperboard product which is easy to manufacture and use.

It is another object of the present invention to provide an authenticatable paper or paperboard product that can be used for labels or packaging of products that are subject to counterfeiting.

Other objects and advantages of the present invention will become apparent from the following detailed description which sets forth several specific embodiments of the invention for the purpose of illustrating suitable modes for practicing the invention.

DETAILED DESCRIPTION

Microdots of starch applied using a printing press to paper or paperboard in a colorless ink vehicle are non-detectable to the human eye and are not detectable under UV light. Thus, the incorporation of starch into a colorless water based printing ink makes it possible to print microdots or other images containing starch on the surface of paper and paperboard products as an authenticable security feature. Such paper or paperboard products could be used to package the legitimate goods of a manufacturer, and a potential counterfeiter of such goods would not be aware of the authenticatable feature since starch is routinely used in the papermaking process at the wet end and size press, and in coating colors. The application of a standard iodine solution according to TAPPI standard T 610 OM-92, to the treated paper or paperboard produces an instantaneous blue/black color in the area of the printed image.

EXAMPLES

Both cationic and anionic starch solutions ranging from about 0.2–1.0% solids were applied to the coated surface of a coated one side (C1S) paperboard product. The starch solutions were applied as microdots by dipping a stiff piece of wire into the solutions and then touching the paperboard surface lightly with the wire tip. The paperboard samples so treated were dried in an oven at 105 degrees C. It was discovered that if the microdots were made small enough, they were not visible to the eye nor were they visible under UV light. However, staining the areas where the microdots were applied with a standard 0.025N iodine solution resulted in the appearance of a blue/black color at the locations of the microdots indicating the presence of starch.

The starch products evaluated included two cationic starches, Chargemaster R630 supplied by Grain Processing Corporation, and Cato 232 supplied by National Starch, and an unmodified pearl starch (anionic) supplied by A. E. Staley. All starch products evaluated produced comparable results. Based on the results of this experiment, it is believed that the printing processes useful for the present invention may include gravure, offset, flexography and ink jet.

In the practice of the present invention, the security feature can be applied to the surface of the finished paper or paperboard products either before or after such products are printed in the usual manner. The security feature can be applied in a location remote from the conventional printed matter applied to the paper or paperboard products. Moreover, as suggested hereinbefore, the security feature can be applied in any one of many different selected designs or configurations. It will be appreciated that particularly fanciful or distinctive security impressions may be preferred to customize certain products, or to code them, or to enumerate them in a series or program. All such advantages may be realized in the practice of the present invention.

Accordingly, while the products and processes described herein are merely for the purpose of illustration only, it is to be understood that the present invention includes all modifications and equivalents which fall within the scope of the invention as defined in the appended claims.

What is claimed is:

1. A method for authenticating security paper comprising:

a) printing an authenticating solution consisting essentially of starch in a selected pattern on at least one surface of the paper; and b) applying to said printed surface an authenticating composition, which is a standard iodine solution, to produce a characteristic starch-iodine coloration of the selected pattern.

2. The method of claim 1 wherein the authenticating starch solution comprises a colorless ink having included therein starch at a solids content of from about 0.2–1.0%.

3. The method of claim 2 wherein the starch is selected from the group consisting of anionic and cationic starches.

4. The method of claim 3 wherein the authenticating composition is a 0.025N solution of iodine in potassium iodide.

5. Security paper subject to being authenticated with an authenticating composition comprising iodine, comprising paper having printed on at least one surface thereof a solution consisting essentially of starch at a solids content of from about 0.2–1.0% in a selected pattern, wherein upon application of a standard iodine solution to the printed paper, a characteristic starch-iodine coloration of the selected pattern is produced.

6. The paper of claim 5 wherein the selected pattern is in the form of discrete microdots applied by a printing process selected from the group consisting of gravure, flexography, offset, and inkjet.

* * * * *